US009260828B2

(12) United States Patent
Houle et al.

(10) Patent No.: US 9,260,828 B2
(45) Date of Patent: Feb. 16, 2016

(54) SAFETY MARKER

(71) Applicant: Emergency Signalization RH inc., Sainte-Catherine-de-la-Jacques-Cartier (CA)

(72) Inventors: Raymond Houle, Sainte-Catherine-de-la-Jacques-Cartier (CA); Gérald Juneau, Sainte-Catherine-de-la-Jacques-Cartier (CA); Michel Juneau, Shannon (CA); André Villemaire, Québec (CA)

(73) Assignee: Emergency Signalization RH inc., Sainte-Catherine (CA)

( * ) Notice: Subject to any disclaimer, the term of this patent is extended or adjusted under 35 U.S.C. 154(b) by 252 days.

(21) Appl. No.: 14/049,579

(22) Filed: Oct. 9, 2013

(65) Prior Publication Data

US 2014/0096712 A1 Apr. 10, 2014

Related U.S. Application Data

(60) Provisional application No. 61/711,776, filed on Oct. 10, 2012.

(51) Int. Cl.

| | |
|---|---|
| ***E01F 9/012*** | (2006.01) |
| ***E01F 9/014*** | (2006.01) |
| ***E01F 9/016*** | (2006.01) |

(52) U.S. Cl.

CPC ..... *E01F 9/0122* (2013.01); *E01F 9/014* (2013.01); *E01F 9/016* (2013.01)

(58) Field of Classification Search

CPC ..... E01F 9/0122

USPC ..... 116/63 P; 135/139; 40/903; 446/107

See application file for complete search history.

(56) References Cited

U.S. PATENT DOCUMENTS

| | | | | |
|---|---|---|---|---|
| 2,561,016 | A | 7/1951 | Ford et al. | |
| 2,762,327 | A | 9/1956 | Weig | |
| 2,808,803 | A | 10/1957 | Weig | |
| 2,957,444 | A | 10/1960 | Boettler | |
| 3,132,624 | A | 5/1964 | Shoemaker | |
| 3,233,352 | A | 2/1966 | Projector et al. | |
| 3,426,343 | A | 2/1969 | Carlson | |
| 3,707,320 | A | 12/1972 | Brynes | |
| 3,750,900 | A | 8/1973 | Piercey | |
| 3,796,004 | A * | 3/1974 | Auerbach | 446/107 |
| 4,197,807 | A | 4/1980 | Campbell | |
| 4,292,627 | A | 9/1981 | Knight | |
| 4,552,089 | A | 11/1985 | Mahoney | |
| 4,597,706 | A | 7/1986 | Michit | |
| D309,273 | S | 7/1990 | Myers et al. | |

(Continued)

FOREIGN PATENT DOCUMENTS

| | | |
|---|---|---|
| WO | 2005091881 | 10/2005 |

*Primary Examiner* — Daniel S Larkin
*Assistant Examiner* — Irving A Campbell
(74) *Attorney, Agent, or Firm* — Fasken Martineau Dumoulin LLP

(57) ABSTRACT

A safety marker apparatus comprising a hollow body including at least four vertex elements interconnected by flexible resilient rods, the body being adapted to be compressed into a stowed state upon application of an external force and expanded into a deployed state, the flexible resilient rods forcing the hollow body to adopt the deployed state in an absence of the external force. In one embodiment, an illumination sub-system is provided in at least one vertex element.

12 Claims, 13 Drawing Sheets

(56) References Cited

U.S. PATENT DOCUMENTS

| | | | | |
|---|---|---|---|---|
| 5,054,648 | A | 10/1991 | Luoma | |
| 5,199,375 | A * | 4/1993 | Johson | 116/209 |
| 5,213,464 | A | 5/1993 | Nicholson et al. | |
| 5,244,334 | A | 9/1993 | Akita et al. | |
| 5,305,705 | A | 4/1994 | Gagliano | |
| 5,488,792 | A | 2/1996 | Kwok | |
| 5,525,021 | A | 6/1996 | Larguier | |
| 6,056,498 | A | 5/2000 | Velinsky et al. | |
| 6,183,042 | B1 | 2/2001 | Unrath | |
| 6,435,369 | B1 | 8/2002 | Poursayadi | |
| 6,752,582 | B2 | 6/2004 | Garcia | |
| 7,164,352 | B2 | 1/2007 | Nelson | |
| 7,228,813 | B2 | 6/2007 | Flamingo et al. | |
| 7,261,051 | B2 | 8/2007 | Tipaldo | |
| 7,350,328 | B1 | 4/2008 | Garcia | |
| 7,395,776 | B2 | 7/2008 | Harruna | |
| 7,538,688 | B1 | 5/2009 | Stewart | |
| 7,571,693 | B2 | 8/2009 | Tipaldo | |
| 7,624,697 | B1 | 12/2009 | Toles | |
| 7,677,831 | B2 | 3/2010 | Kulp et al. | |
| 7,694,465 | B2 | 4/2010 | Pryor | |
| 7,731,449 | B2 | 6/2010 | Kulp et al. | |
| 7,811,026 | B1 | 10/2010 | Kulp et al. | |
| 7,866,914 | B2 | 1/2011 | Kulp et al. | |
| 7,997,764 | B1 * | 8/2011 | Nielson | 362/249.02 |
| 8,152,325 | B2 | 4/2012 | McDermott | |
| 8,157,404 | B2 | 4/2012 | McDermott | |
| 8,963,739 | B2 * | 2/2015 | Clifford et al. | 340/908.1 |
| 2003/0210975 | A1 | 11/2003 | Garcia | |
| 2005/0046596 | A1 | 3/2005 | Nelson | |
| 2005/0095105 | A1 | 5/2005 | Parks | |
| 2006/0016383 | A1 | 1/2006 | Flamingo et al. | |
| 2006/0219153 | A1 | 10/2006 | Tipaldo | |
| 2006/0272265 | A1 | 12/2006 | Pryor | |
| 2007/0266925 | A1 | 11/2007 | Tipaldo | |
| 2008/0006199 | A1 | 1/2008 | Harruna | |
| 2008/0075531 | A1 | 3/2008 | Kulp et al. | |
| 2009/0022547 | A1 * | 1/2009 | Lo | 404/9 |
| 2009/0139443 | A1 | 6/2009 | Kulp et al. | |
| 2010/0021232 | A1 | 1/2010 | Kulp et al. | |
| 2010/0265699 | A1 | 10/2010 | Nielson et al. | |
| 2010/0321934 | A1 | 12/2010 | McDermott | |
| 2011/0058364 | A1 | 3/2011 | McDermott | |
| 2011/0308446 | A1 | 12/2011 | Butler | |

* cited by examiner

SAFETY MARKER

TECHNICAL FIELD

This invention relates to the field of road safety and more particularly to safety markers.

BACKGROUND OF THE ART

Transportation using motor vehicles is an integral part of the daily life of a large part of humanity. The speed, efficiency and convenience of modern road systems have improved a great deal since the time when the first roads were built. The safety of motor vehicles has also increased substantially over recent years.

Despite these improvements, roughly 30 thousand people lose their life and 2 million people are injured in the more than 10 million vehicle accidents reported each year in the United States alone.

Highway vehicle accident scenes are very dangerous since they create a stationary obstacle while incoming vehicles travel at high-speed. First respondents to a vehicle crash site face the most dangerous task of setting up the initial security perimeter aiming at diverting the incoming traffic away from the damaged vehicles and injured passengers. Each year in the United States alone, millions of law officers and first respondents risk their life working on roads and thousands are injured or die every year because of the unavailability of adequate tools to perform these tasks safely.

"Move over" laws have been passed in the great majority of the US states and in all Canadian provinces. These laws make it compulsory for drivers to slow down or change lanes and move away from stopped emergency vehicles. Despite these laws, too many accidents still occur every year.

Various types of road safety markers exist but the prior art systems have many drawbacks and limitations. There is still a need for a road safety marker which can be disposed quickly and efficiently on the road by the first respondents, either manually or through an automated dispenser.

SUMMARY

A safety road marker is provided. It contributes to establish a safety perimeter and helps divert incoming traffic.

According to one broad aspect of the present invention, there is provided a safety marker apparatus comprising a hollow body including at least four vertex elements interconnected by flexible resilient rods, the body being adapted to be compressed into a stowed state upon application of an external force and expanded into a deployed state, the flexible resilient rods forcing the hollow body to adopt the deployed state in an absence of the external force.

In one embodiment, an illumination sub-system is provided in at least one vertex element.

In one embodiment, the safety marker further comprises at least one fabric sheet, the fabric sheet being attached to the hollow body, the fabric sheet being flexible and adapted to move with air circulation.

In one embodiment, the safety marker further comprises an encapsulating shell for receiving and retaining the body in the stowed state.

In one embodiment, one of the at least four vertex elements is adapted to mate with others of the at least four vertex elements in the stowed state.

In one embodiment, the safety marker further comprises a retaining band, the retaining band being adapted to retain the body in the stowed state.

In one embodiment, the safety marker further comprises at least one retro-reflecting element affixed to the body.

In one embodiment, a configuration of the vertex elements and the rods provides a substantially symmetrical hollow body.

In one embodiment, the at least four vertex elements is four vertex elements and wherein the four vertex elements are interconnected by six flexible resilient rods.

In one embodiment, at least one of the four vertex elements is an illuminating vertex element, wherein the safety marker further comprises a battery-powered light source provided in the illuminating vertex elements, the battery-powered light source being switched on in the deployed state and being switched off in the stowed state.

In one embodiment, the safety marker further comprises a magnetic switch for the battery-powered light source and a permanent magnet, wherein the battery-powered light source is switched off by a proximity of the permanent magnet to the illuminating vertex element in the stowed state and switched on by a distance of the permanent magnet from the illuminating vertex element in the deployed state.

In one embodiment, the permanent magnet is provided on one of another one of the four vertex elements and a casing for the marker.

In one embodiment, the safety marker further comprises a controller for the battery-powered light source, the controller controlling the battery-powered light source to emit light one of continuously and intermittently.

In one embodiment, the safety marker further comprises an optical detector for detecting an illumination signal, wherein the controller controls at least one of a frequency and a timing of intermittent illumination of the battery-powered light source using the illumination signal.

BRIEF DESCRIPTION OF THE DRAWINGS

Having thus generally described the nature of the invention, reference will now be made to the accompanying drawings, showing by way of illustration an example embodiment thereof and in which

FIG. 4 includes FIG. 4A, FIG. 4B, FIG. 4C in which

FIG. 6 includes FIG. 6A, FIG. 6B, FIG. 6C and FIG. 6D in which

FIG. 11 includes FIG. 11A and FIG. 11B in which

It will be noted that throughout the appended drawings, like features are identified by like reference numerals.

DETAILED DESCRIPTION

Figure 1:
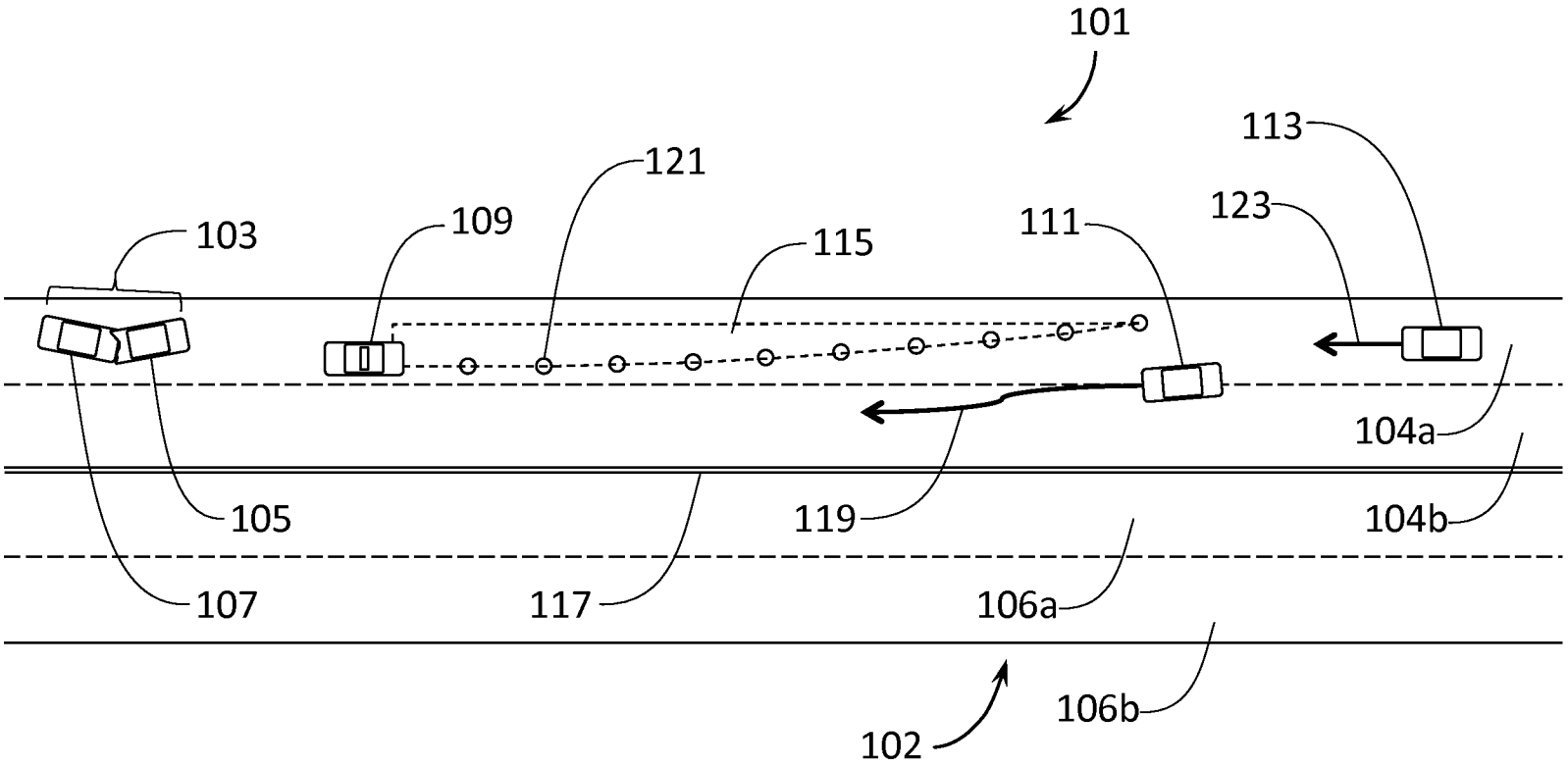
FIG. 1 is a top view of a scene of a vehicle crash with a security perimeter and incoming traffic.

FIG. 1 depicts a crash scene 101 on a highway 102. The highway includes two lanes of left-bound traffic 104*a*, 104*b* and two lanes of right-bound traffic 106*a*, 106*b*. Vehicle 105 has collided with another vehicle 107 at a crash site 103 in left-bound lane 104*a*. A police vehicle 109 is present at the scene. Vehicles 111 and 113 are part of the incoming traffic in left-bound lanes 104*a*, 104*b*. Vehicle 111 has trajectory 119 and vehicle 113 has trajectory 123.

The crash site 103 will be made safer if the incoming traffic is diverted to the other left-bound lane 104*b*. Safety perimeter 115 can be established by the first respondent, in this case the police officer. The safety perimeter 115 indicates to the drivers of the incoming vehicles that they should move their vehicle towards the centerline 117, away from the crash site 103. Incoming vehicle 111 should be enticed to follow a safe trajectory 119 towards the centerline 117, in order to lower the chance of collision with the vehicles 105, 107 at the crash site 103 and the persons walking around the crash site 103. One method of setting up a safety perimeter 115 consists of placing individual safety markers 121 at substantially regular intervals over a length of road preceding the crash site 103.

Figure 2:
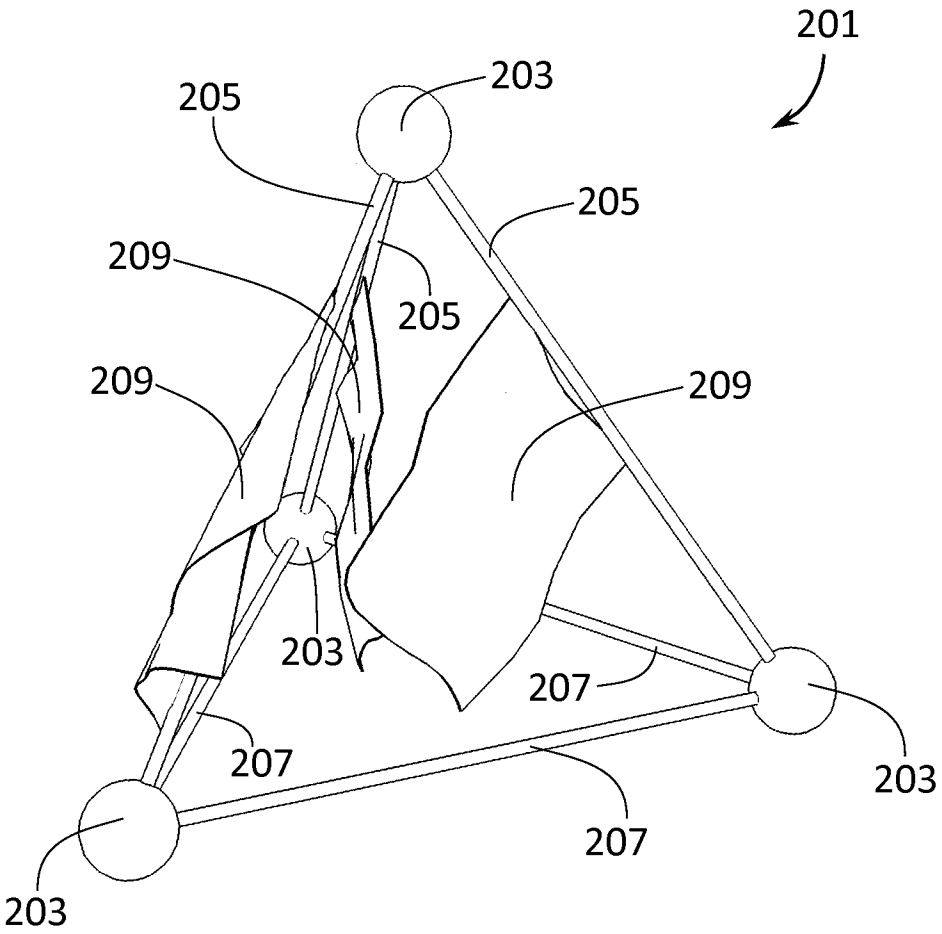
FIG. 2 is a perspective view of an example hollow tetrahedral marker with flags attached to three rods of the marker.

In one embodiment of the invention shown in FIG. 2, the safety marker 201 consists of a hollow tetrahedral structure. In this example embodiment, the four vertices 203 of the tetrahedron are connected by rods 205 and 207, made of a flexible and springy material. This material can be a metal spring coil, a springy plastic material or any other suitable materials. For example, the rod can be made of ASTM-A227 or ASTM-A764 compliant material of HDMB quality. It can have a Bezelplast colored coating or can be galvanized. The rod may be tubular, planar or other.

Although illustrated as spheres, the vertex elements need not be enclosed structures. The outside portion of vertices 203 which is meant to contact the ground can be made of a variety of materials, for example rubber or plastic. It can be roughened to improve adherence to the surface on which it rests. The inside portion of the vertices 203 which faces the interior of the hollow structure is protected from an impact with the ground by the body of the marker. It can be made of the same material as the outside portion or can be made of a different material. For example the vertex elements can be made of acrylic, polymers or epoxy.

The hollow body of the safety marker forms a structure which has a height sufficient to attract the attention of the drivers of the incoming vehicles. In an example embodiment, the height of the hollow body is 14 inches. The length of the rod, in an embodiment in which the hollow tetrahedral structure is regular is 9 inches. The size of the rod is sufficient to allow the tetrahedral structure to stand and withstand winds. An example diameter for the rod, if it is cylindrical, is 4 mm.

Hollow marker structures present a small surface area and are less susceptible to being pushed or blown from their intended position by wind and air currents.

Rods 205 are equipped with small flags 209 made of a fabric-like material such as a thin polymer sheet or coated nylon sheet. This material can be dyed or coated with a bright color such as orange. Optionally the material can also reflect light preferentially towards the source of illumination in order to increase its visibility during nighttime. Note that in another embodiment of the invention, all rods 205 and 207 can be equipped with such small flags 209.

The connecting rods 205 and 207 can also feature a reflective coating in order to enhance their visibility. Optionally, retro-reflective elements can be affixed to the rods or the vertex elements. The rods themselves could also be illuminated.

Optionally, the vertices are embedded with battery-powered light sources, in order for the marker to be as visible as possible during nighttime. The light sources can be Light Emitting Diodes (LED), incandescent bulbs or any other suitable source of light. The lights can be operated to emit light continuously or in a flashing manner, thus being more noticeable while saving battery power. The emitted light can be white, red or of another suitable color. A light source bundle can be used wherein more than one color is emitted. The light sources are contained in vertex enclosures, here depicted as small spheres. The vertex enclosures are preferably translucent. The outer surface of the enclosure can be roughened in order to diffuse outgoing light and appear as a large emitter source. In another embodiment, light sources could also be embedded in at least some of the connecting rods 205 and 207.

Optionally, a central illuminating element could be provided. This central illuminating element would be attached to at least one vertex element and be provided within the hollow body of the marker, for example by gravity. This central illuminating element would be provided with a battery-powered light source similar to that optionally used in the vertex elements.

Figure 3A:
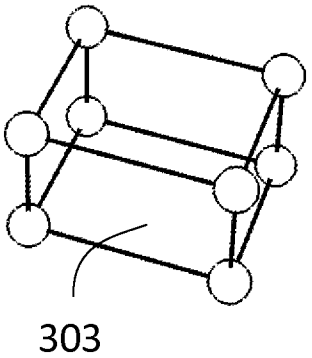
FIG. 3 includes FIG. 3A, FIG. 3B, FIG. 3C, FIG. 3D, FIG. 3E which show alternative geometrical shapes that can be used to construct hollow markers.
Figure 3B:
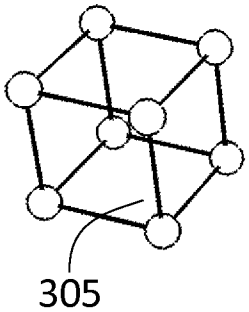
Figure 3C:
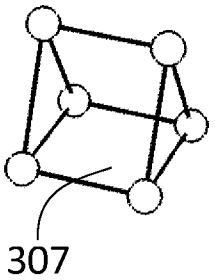
Figure 3D:
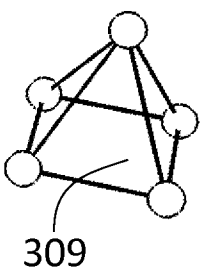
Figure 3E:
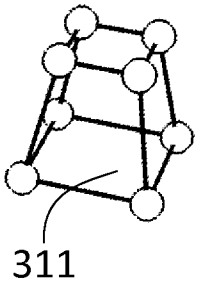

It is understood that geometric shapes other than the tetrahedron shown in FIG. 2 can be used to create a marker with desirable properties. FIG. 3 shows several examples of alternate geometric shapes for the marker, including a rectangular parallelepiped 303 (FIG. 3A), a cube 305 (FIG. 3B), a triangular prism 307 (FIG. 3C), square pyramid 309 (FIG. 3D) and a pyramidal fustrum 311 (FIG. 3E).

Figure 4C:
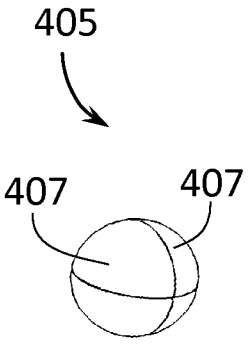
FIG. 4B is the marker of FIG. 4A partially compressed into a ball and being inserted inside two hemispheric shells and FIG. 4C is the marker of FIG. 4A inserted inside the two hemispheric shells to form a self-contained ball.
Figure 4B:
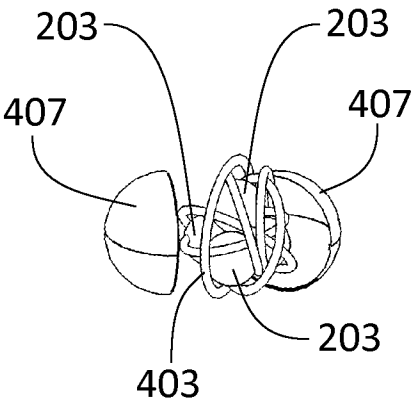
Figure 4A:
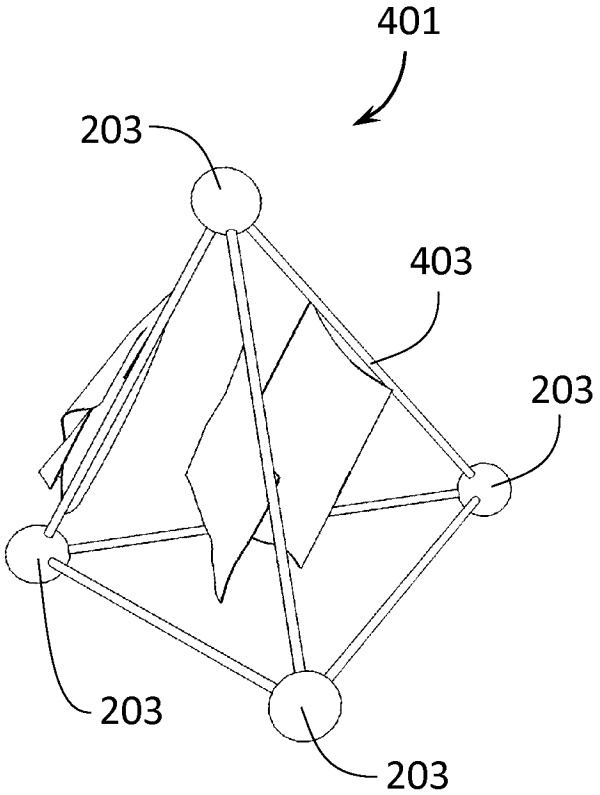
FIG. 4A shows the marker of FIG. 2.

Hollow geometric structures composed of vertices and flexible rods can be compressed into a very small volume for stowage. FIG. 4A, FIG. 4B and FIG. 4C show an encapsulation sequence of a hollow tetrahedral marker 401 into a ball 405. The ball 405 is composed of two hemispherical hollow shells 407. Starting from its deployed state shown in FIG. 4A, the tetrahedral marker 401 is collapsed onto itself until the vertices 203 touch or almost touch as in FIG. 4B. In FIG. 4B the compressed marker 401 is seen with the rods 403 wrapped around the vertices 203 and being inserted in the hollow shells 407. In FIG. 4C the marker 401 is completely encapsulated in a stowed marker ball 405. The two hollow shells are affixed to one another using means known in the art. As will be readily understood the hollow shells could be of different shapes to create an encapsulated marker with a shape other than a sphere, such as a conical structure or a disk, for example.

Figure 5:
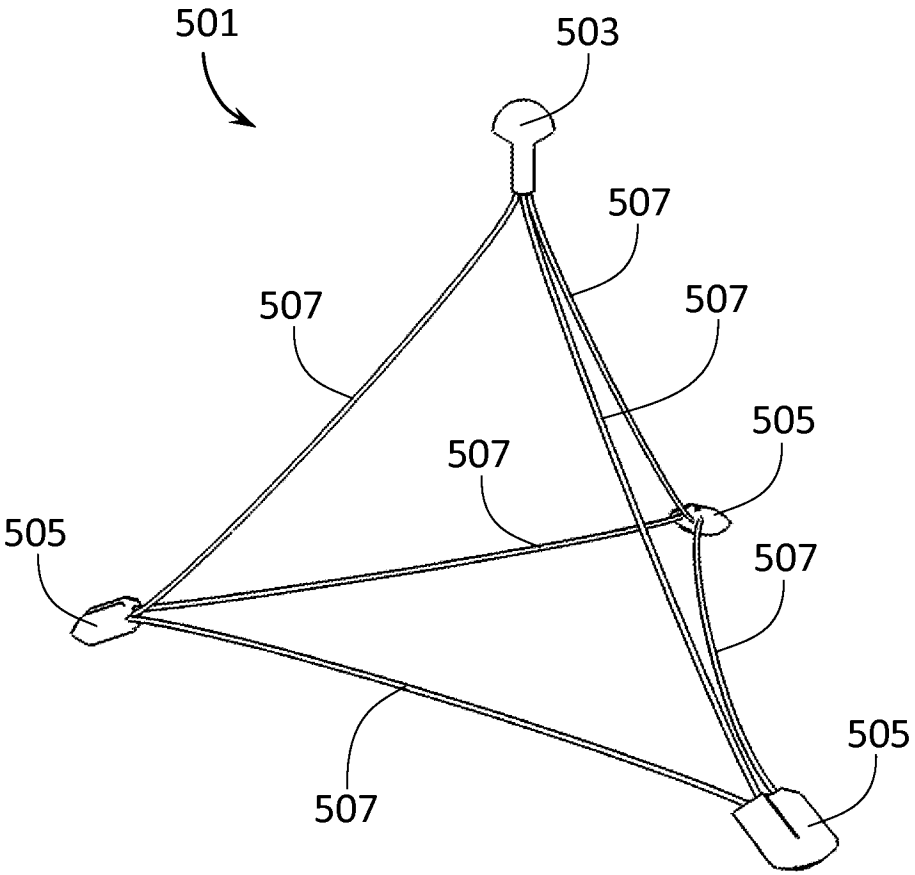
FIG. 5 is a perspective view of another example hollow tetrahedral marker using two different types of vertices.

FIG. 5 shows another example embodiment of a marker 501. In this example embodiment, six flexible rods 507 connect the primary vertex 503 and the three secondary vertices 505 of the tetrahedron.

Figures 6A, 6B, 6C, 6D:
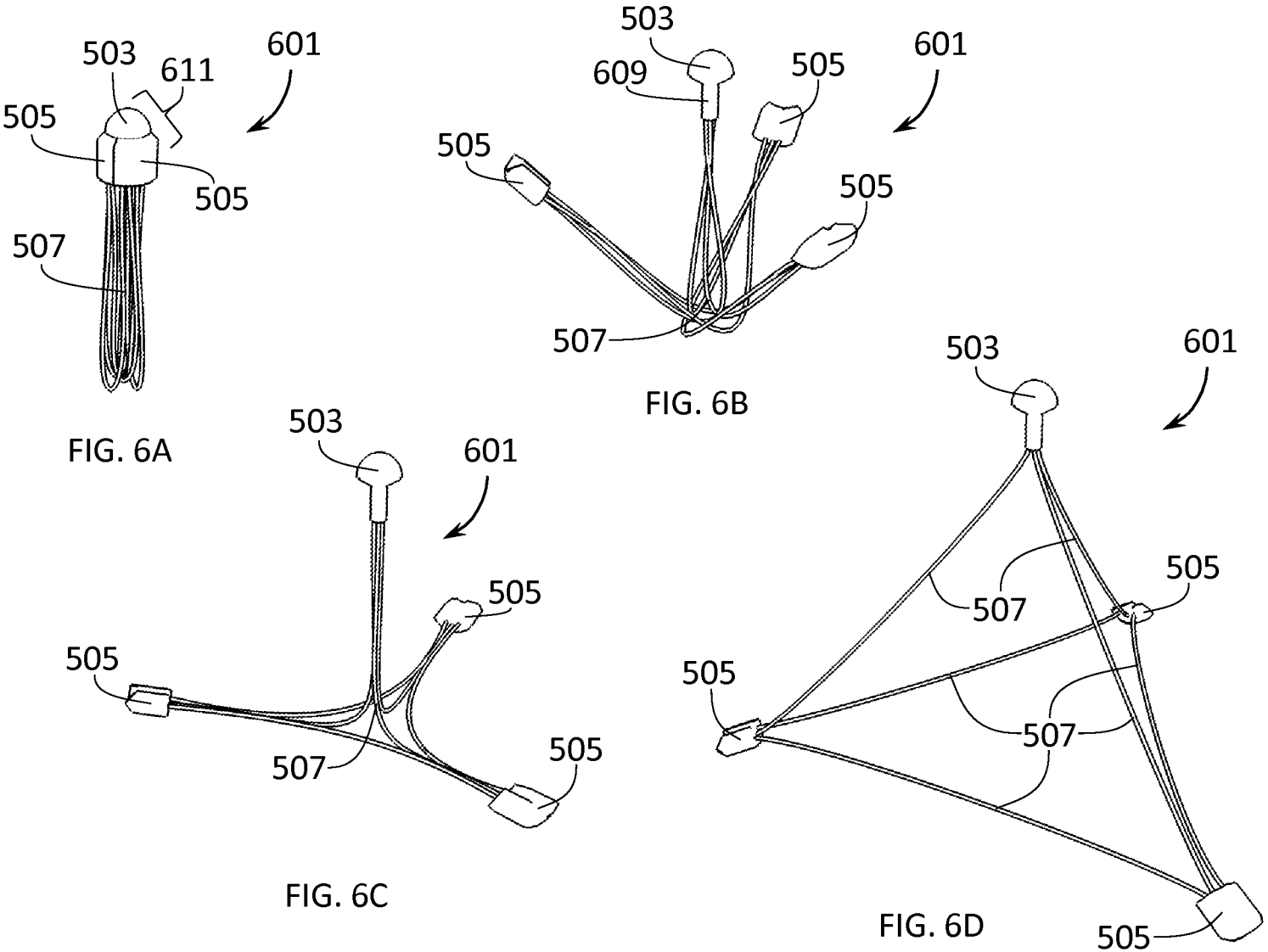
FIG. 6A is the marker of FIG. 5 in the stowed state.
FIG. 6B is the marker of FIG. 6A in a state one-third deployed.
FIG. 6C is the marker of FIG. 6A in a state two thirds deployed and FIG. 6D is the marker of FIG. 6A in the deployed state.

The vertices 503, 505 of the example embodiment safety marker shown in FIG. 5 are designed to mate in the manner illustrated in FIG. 6A. FIG. 6A shows the safety marker 601 packaged in its stowed state. In this configuration, the three secondary vertices 505 form a hollow cylinder around the stem 609 of the primary vertex 503, constructing a compact vertex subassembly 611. The flexible rods 507 are neatly folded in two under the vertex assembly 611. A retainer band made of flexible material can be wrapped around the flexible rods 507, or around the three secondary vertices 505 in order to maintain the safety marker 601 in its stowed state. The retainer band can be a Velcro™ strip affixed to one of the rods.

FIG. 6B shows the safety marker 601 being released from its stowed state. The spring restoring force of the flexible rods 507 can contribute in pulling the three secondary vertices 505 apart from the primary vertex 503. FIG. 6C shows the safety marker 601 at a further intermediary stage of deployment.

FIG. 6D shows the fully deployed marker 601. Note that in this deployed state, the marker 601 can also be oriented with the primary vertex 503 in one of the lower positions and with one of the secondary vertices 505 in the upper position.

Figure 7:
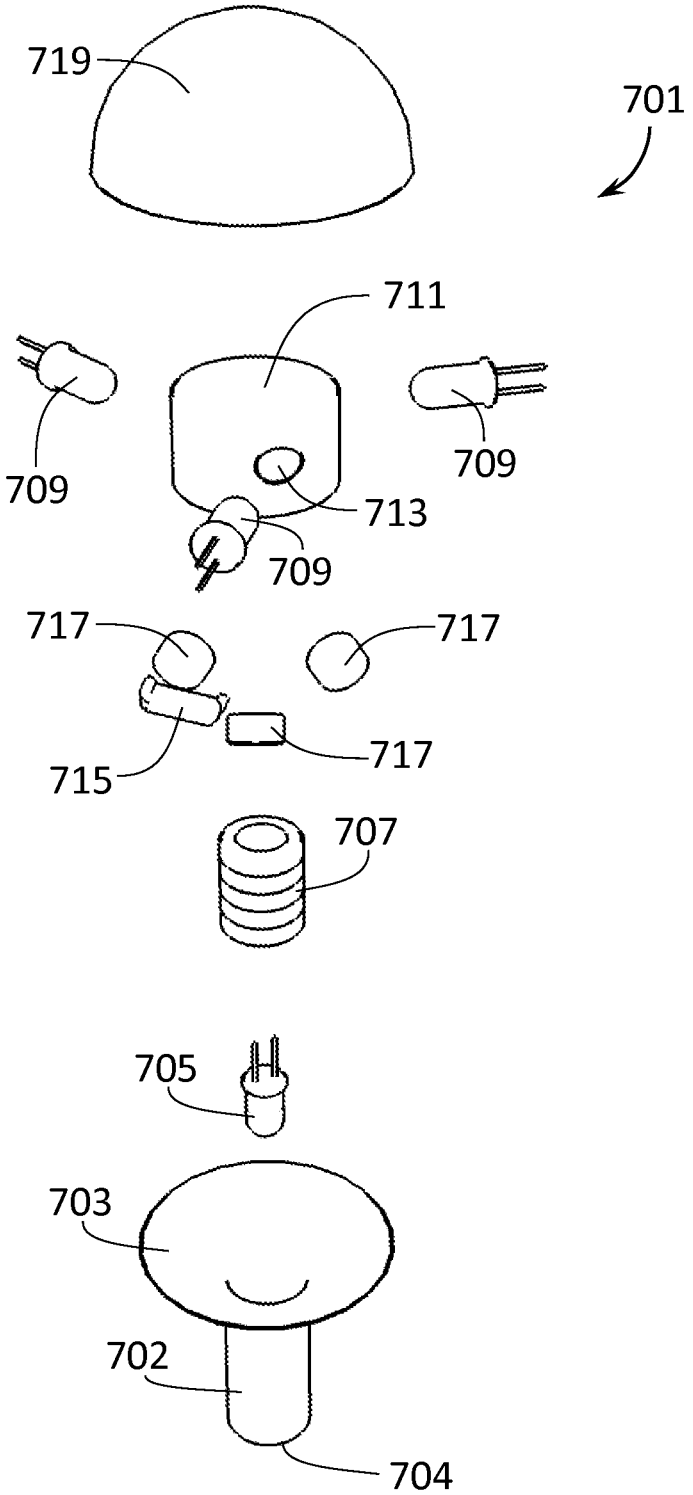
FIG. 7 is an exploded view of the principal vertex of the marker shown in FIG. 5.

FIG. 7 shows an exploded view of an example embodiment of the primary vertex 701 of the marker 501. The lower part 703 of the primary vertex enclosure can be made of a plastic shell with a hollow cylindrical part 702 terminated with a circular end 704 at the bottom where a round hole is placed to allow a light emitting diode 705 to be positioned and to protrude in the cylindrical part 702 of the lower part 703. This light emitting diode 705 can thus shine light on the marker 501 in its deployed state including on the flags installed on the marker rods 207. Alternatively, the light emitting diode 705 can be enclosed in the lower part 703 of the primary vertex, if this section of the enclosure is made of a transparent material.

An assembly of batteries 707 used to power the light emitting diode 705 as well as additional light emitting diodes 709 is shown in FIG. 7. These batteries 707 fit inside the hollow cylindrical part 702 in the lower part 703. Five such batteries 707 are used. The three light emitting diodes 709 can be positioned using a transparent cylinder 711 featuring three holes 713.

The upper section of the enclosure also includes a magnetic switch 715 and three magnets 717. The magnetic switch 715 is used to switch the primary vertex light emitting diodes electrical circuit on and off, as described in FIG. 8. The magnets 717 are used to switch the secondary vertex light emitting diodes electrical circuit on and off, as illustrated in FIG. 9.

The example primary vertex assembly can be protected from the elements (rain, snow, dust, etc.) by affixing and/or sealing the lower part 703 and upper shell 719 together. The upper shell 719 can be made of a translucent material to allow the three upper light emitting diodes 709 to emit light towards external observers. The electric components of this example primary vertex assembly can be connected using printed circuit boards and wires (not shown in FIG. 7).

As will be readily understood, a handle can be provided on the exterior surface of the upper shell 719 to facilitate transportation of the marker by a user.

Figure 8:
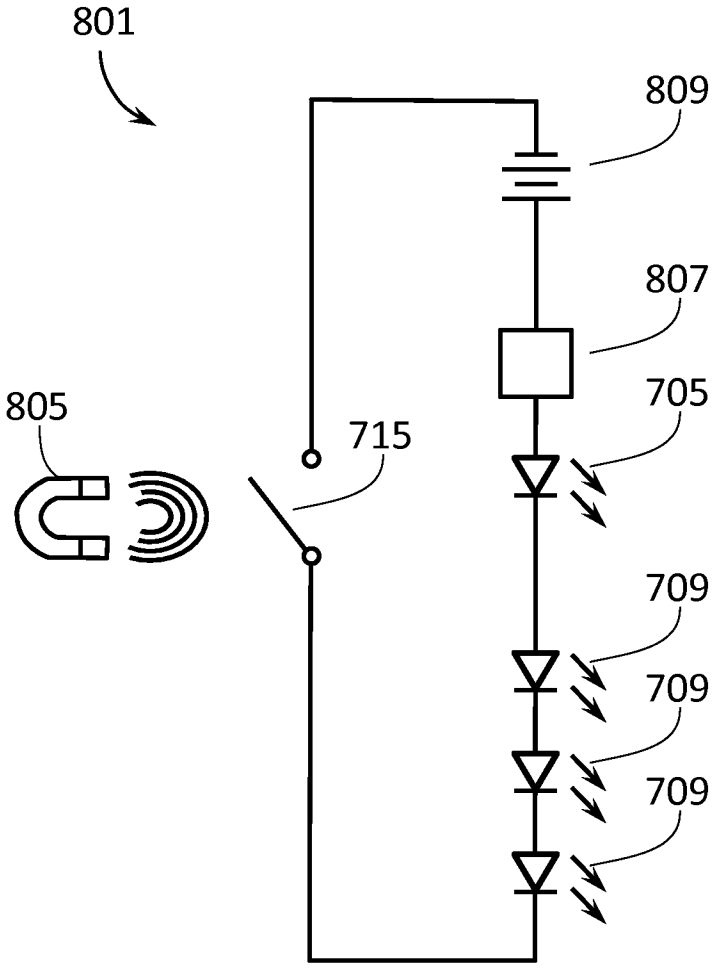
FIG. 8 is an example schematic of the electronic circuit contained in the principal vertex of the marker shown in FIG. 5.
Figure 9:
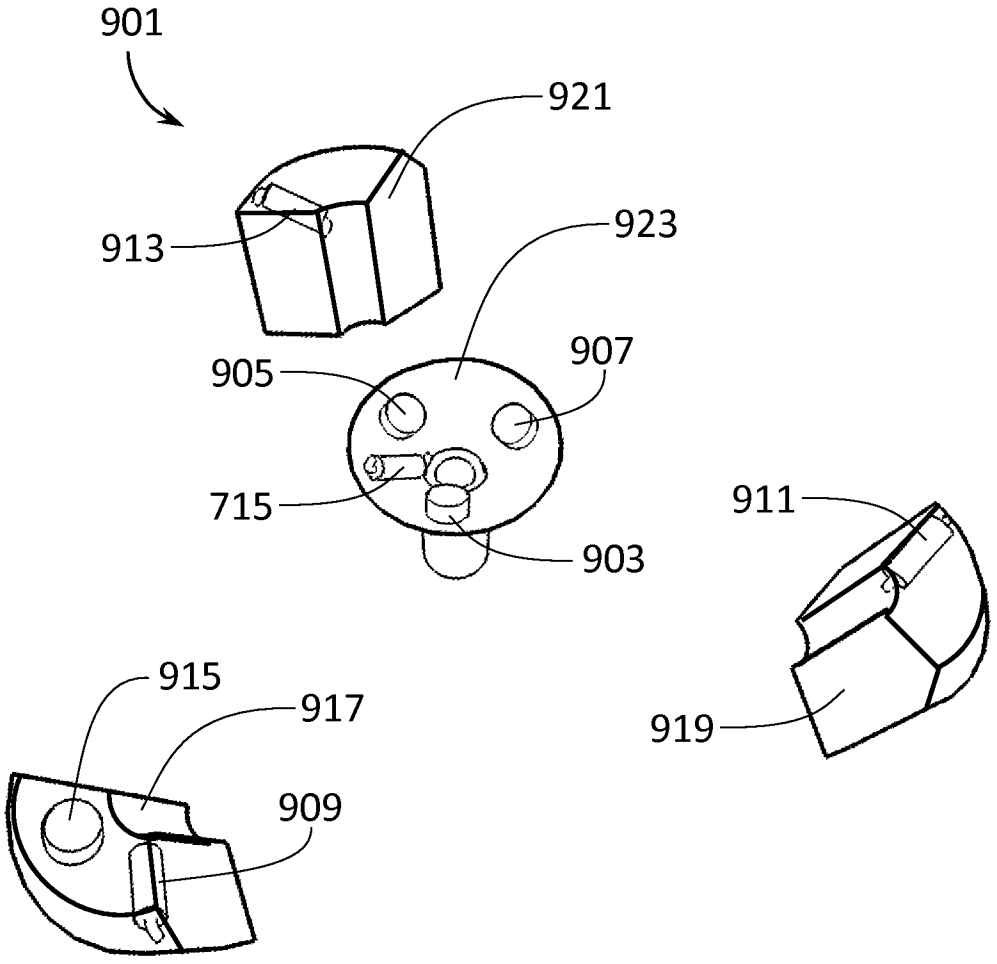
FIG. 9 is an internal view of the vertices of the marker shown in FIG. 5 showing magnetic switches and magnets.

FIG. 8 shows an example electrical circuit 801 used to power the light emitting diodes 705 and 709. In this example the light emitting diodes are connected in series and are powered using battery set 809. The light emitting diodes 705 and 709 are turned on and off using a magnetic switch 715 placed in series with the light emitting diodes 705 and 709 and battery set 809. When there is no magnetic stimulation, the magnetic switch 715 is closed and the light emitting diodes emit light. When a magnetic field is present in the vicinity of the magnetic switch 715, the magnetic switch opens the electrical circuit 801 and the light emitting diodes cannot emit light. Bringing a permanent magnet 805 close to the magnetic switch 715 can generate a magnetic field and interrupt the circuit.

The electrical circuit 801 can also be equipped with an intermittent switch 807, causing the light emitting diodes to emit flashes of light instead of a continuous luminous flux. This mode of operation is more noticeable to an observer while consuming less power. This intermittent switch can in some cases be integrated in one of the light emitting diodes, such as light emitting diode 705.

The secondary vertices can be equipped with similar circuits as described in FIG. 8 to allow the secondary vertices to also emit light, thereby improving the visibility of the safety marker.

In another embodiment, the magnetic switch is replaced by a mechanical switch. During stowage, a portion of the marker abuts a pressure switch for the battery-powered light source. Once the marker is deployed, the pressure switch is freed and the light source is turned on. Another type of mechanical switch is a shock switch. The light source could be turned on upon contact by the marker with the ground above a certain speed.

In another embodiment, a plastic or cardboard sheet is inserted between two batteries of the battery set for the battery-powered light source prior to stowage. An end of this sheet protrudes from the vertex elements. During stowage, the plastic or cardboard sheet prevents the two batteries from contacting one another and therefore ensures that the light source remains off. Upon deployment, the sheet is removed, either manually or by an automated pull of the sheet. The two batteries then enter in contact since they are spring-loaded in the battery compartment. The light source turns on.

FIG. 9 shows an example relative positioning of the primary vertex magnetic switch 715 and primary vertex magnets 903, 905 and 907, as well as the secondary vertex magnetic switches 909, 911 and 913 and the secondary vertex magnet 915. In this example the secondary vertices 917, 919 and 921 are separated from the primary vertex 923, thereby deactivating the magnetic switches and allowing the light emitting diode circuits to operate.

The primary vertex magnetic switch 715 is activated by the magnet 915 installed in the secondary vertex 917, when the safety marker is in the stowed position as illustrated in FIG. 6A. Similarly each secondary vertex has a magnetic switch that can be activated by a permanent magnet installed in the primary vertex 923. When the safety marker is in the stowed position, the primary vertex magnet 903 activates the magnetic switch 909 of secondary vertex 917, preventing the secondary vertex 917 light emitting diode circuit to operate. Likewise in this stowed position, the primary vertex magnet 905 activates the magnetic switch 913 of secondary vertex 921 and the primary vertex magnet 907 activates the magnetic switch 911 of secondary vertex 919. In this configuration, none of the secondary vertex 917 light emitting diode circuits can operate.

In another embodiment, the magnetic switch is composed of a permanent magnet on a casing and of a magnetic field activated switch for each battery-powered light source in the marker. During stowage, the casing is placed in proximity to the magnetic field activated switch and ensures that the battery-powered light source remains off. When the casing is removed, the permanent magnet is moved away from the magnetic switch, thereby allowing the battery-powered light source to be turned on. The casing can also serve as the element which applies an external force on the marker to keep it in the stowed configuration. Upon removal of the casing, the marker is freed and achieves its deployed configuration.

Alternatively, the light emitting diodes in a safety marker could be powered using a single electrical circuit instead of having one independent circuit per vertex. With a single electrical circuit per safety marker, wires have to be installed inside or along the marker rods.

As will be readily understood, the markers can be deployed manually from their stowed state to their deployed state. The user simply removes the element which creates the external force applied onto the marker in the stowed state and the hollow body adopts the deployed state in an absence of the external force. The element which creates the external force can be a retaining band, a casing, a magnet, a shell, a polymer wrapping, etc. Once deployed, the markers can be manually positioned on the surface as required.

Figure 10:
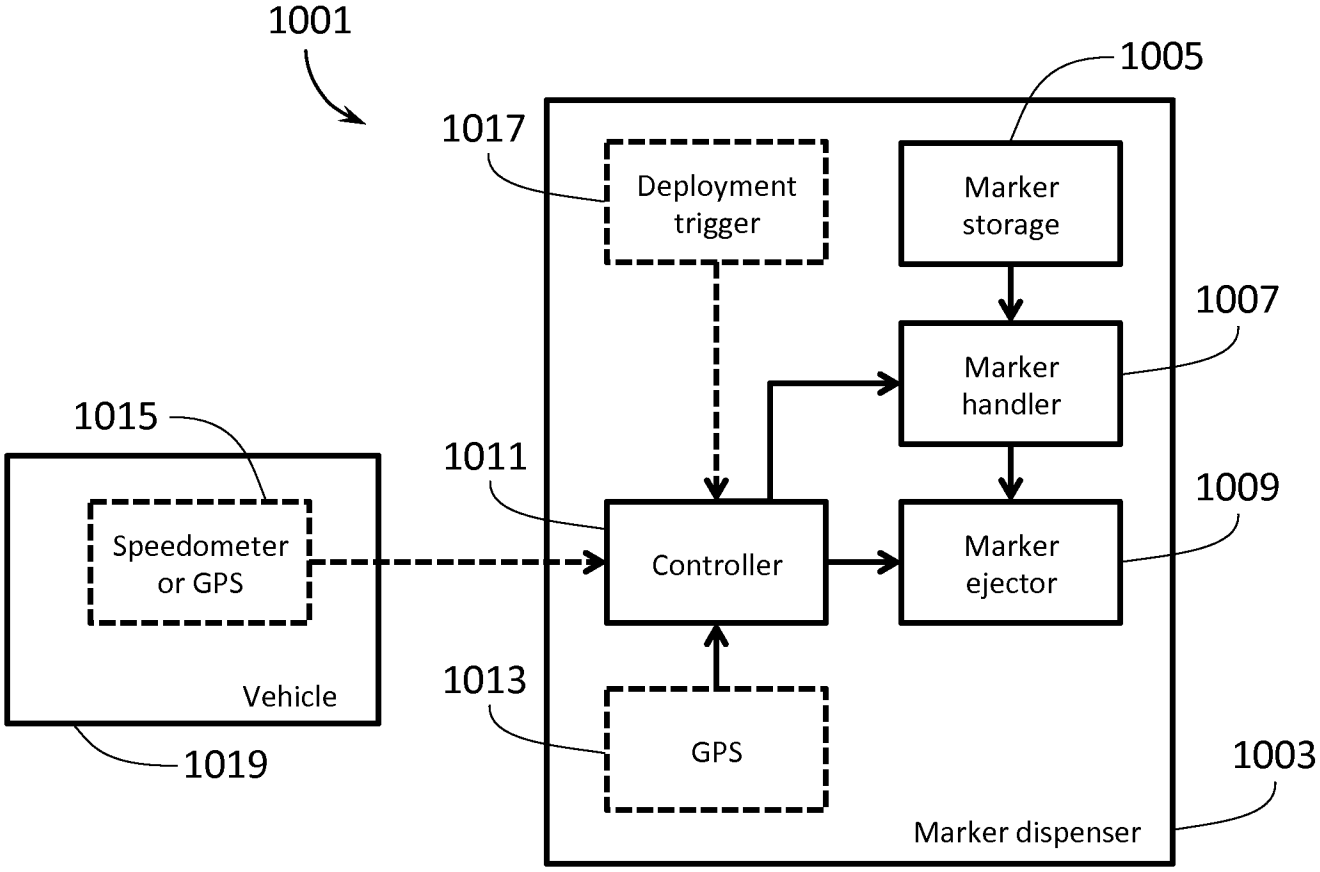
FIG. 10 is block diagram of an example marker dispenser and a peripheral connection to the vehicle to which it is attached.

Alternatively, the markers can be deployed and positioned using an automatic dispensing system. FIG. 10 shows a block diagram 1001 for an example embodiment of a safety marker dispenser system 1003. Multiple markers are stored inside a marker storage device 1005 (e.g. a magazine or a cartridge) in order to allow the deployment of an appropriate number of safety markers to construct an adequately sized safety perimeter 115. The marker dispenser system 1003 can feature a marker handling subsystem 1007 to bring one marker at a time towards a marker ejector 1009. The dispenser controller 1011 orchestrates the action of the marker handler 1007 and the marker ejector 1009 in order to correctly dispense the markers.

The ejection mechanism contained in the marker ejector 1009 can be modulated in order to achieve a variable amount of force exerted on the ejected marker and consequently a variable exiting speed of the ejected marker. In one embodiment of the invention, the markers are ejected with the opposite velocity of the vehicle 1019 carrying the dispenser 1003. In this case, the markers appear to be dropped vertically from the dispenser with little horizontal velocity with respect to the road. This condition ensures that the markers fall close to the ejection point and minimizes the risk of having markers bounce off the road surface and follow unpredictable trajectories.

It is understood that several methods can be utilized to eject the markers from the marker dispenser including: rotating wheels, mechanically compressed or elongated springs, mechanical cams, hydraulic and pneumatic approaches or combinations of these methods.

In order for this relative velocity nulling function to be implemented, the information on the speed of the vehicle 1019 needs to be taken into account by the dispenser controller 1011. One approach is to include a global positioning system (GPS) 1013 in the dispenser system 1003 and have the dispenser controller 1011 calculate the speed by taking the derivative of the position with respect to time. An alternative approach is to transmit to the dispenser controller 1011 the speed information if available in the vehicle 1019 to which the marker dispenser 1003 is attached. In this case, the speed information can be transmitted using either an electrical analog signal, an electrical digital signal or a mechanical method. Other approaches can also be used to derive the vehicle speed, including air pressure sensing or optical monitoring of the road surface. Regardless of the method used to derive the velocity information, it can be used to modulate the amplitude of the ejection mechanism in order to impart to the marker a velocity that compensates the velocity of the vehicle to which the marker dispenser is attached.

In one embodiment of the invention, the speed information is also used to control the deployment of markers. Indeed, a lower speed limit, for example 30 km/h (or any other desired value), can be programmed in the dispenser controller 1011 as a condition to meet in order to permit the deployment. If the vehicle is travelling at a speed lower than this lower limit, including being stationary, the dispenser controller 1011 will not allow the deployment of markers. Similarly, an upper speed limit, for example 100 km/h (or any other desired value), can also be programmed to restrict deployment when the first respondent's vehicle is travelling at normal highway speeds. In this case, the deployment is allowed when the respondent's vehicle slows down at a speed lower than the upper limit, as it approaches the scene.

In one embodiment of the invention the deployment of the markers is triggered without user action when the vehicle carrying the marker dispenser comes in the geographical vicinity of the site of the accident. This approach requires an accurate knowledge of the position of the respondent's vehicle either by using a vehicle GPS 1015 or a GPS 1013 embedded in the marker dispenser system. This approach also requires the knowledge of precise spatial coordinates of the site of the accident. This information can be obtained by standard communications networks, such as cellular, digital data or short-wave radio.

In another embodiment of the invention, it is the occupants of the vehicle that decide when to deploy the markers. While approaching the scene of the accident, the occupants decide when to deploy the safety perimeter by pressing a deployment button or trigger 1017 located inside the vehicle. This button can communicate with the dispenser controller 1011 inside the marker dispenser 1003 via a wireless radio-frequency link or alternatively via a wire running from the deploy button or trigger 1017 to the marker dispenser 1003. The wireless radio-frequency link can be installed easily and enables a rich communication path allowing to relay status information from the marker dispenser 1003 to the occupants of the vehicle regarding the deployment operation. This status information can include for example the system states including standby, on-going deployment, deployment completed or malfunction, as well as the number of marker deployed. This information could appear near the deploy button, on a small liquid crystal display, light emitting diode display, or could be represented using a set of discrete light emitting diode indicators.

The marker dispenser 1003 can be connected to the vehicle power or alternatively, it can operate on internal battery power.

Figure 11B:
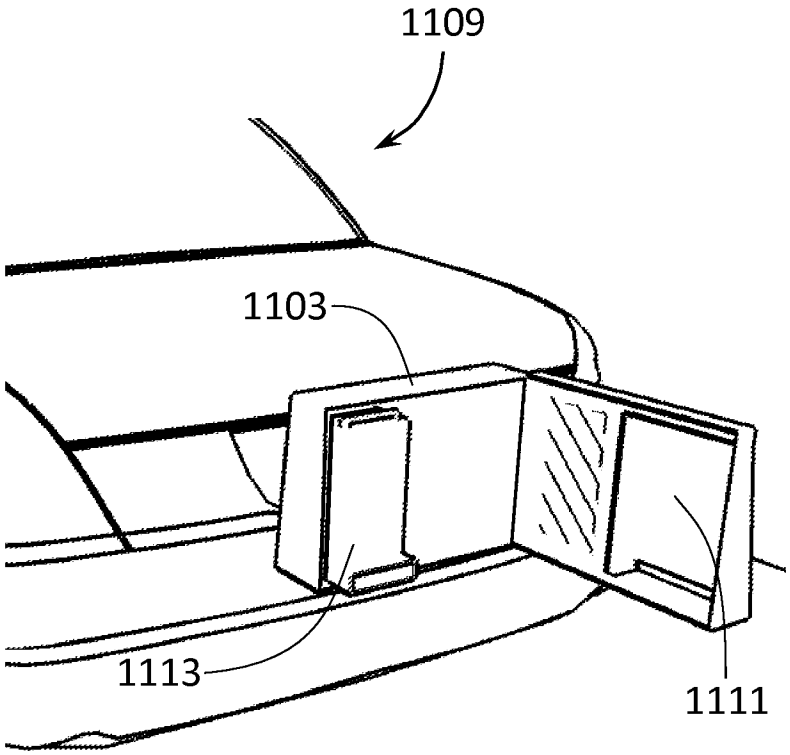
FIG. 11A is an illustration of an example safety marker dispenser installed on a rear bumper of a car and FIG. 11B is an illustration of the example safety marker dispenser shown in FIG. 11A showing an internal marker cartridge.
Figure 11A:
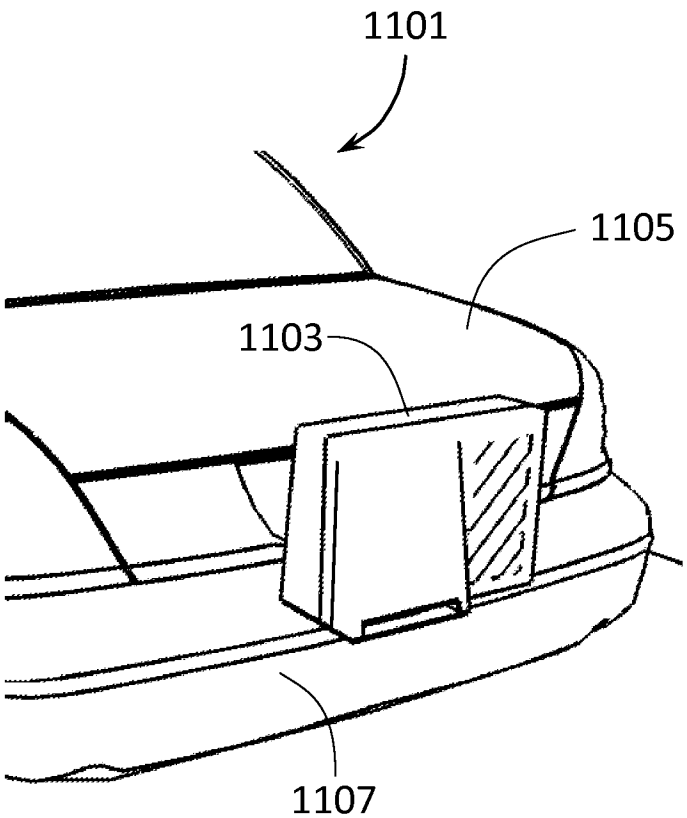

FIG. 11A shows an example embodiment of the invention where the marker dispenser 1103 is installed on the rear bumper 1107 near the trunk 1105 of a respondent's vehicle 1101. The marker dispenser 1103 can be secured using a number of methods including bolting on the bumper 1107 or mounting on the vehicle hitch interface.

FIG. 11B shows the same example marker dispenser 1103 with its door 1111 open. The stowed markers can be stored inside a removable marker cartridge 1113 that can be replaced quickly after usage.

Figure 12:
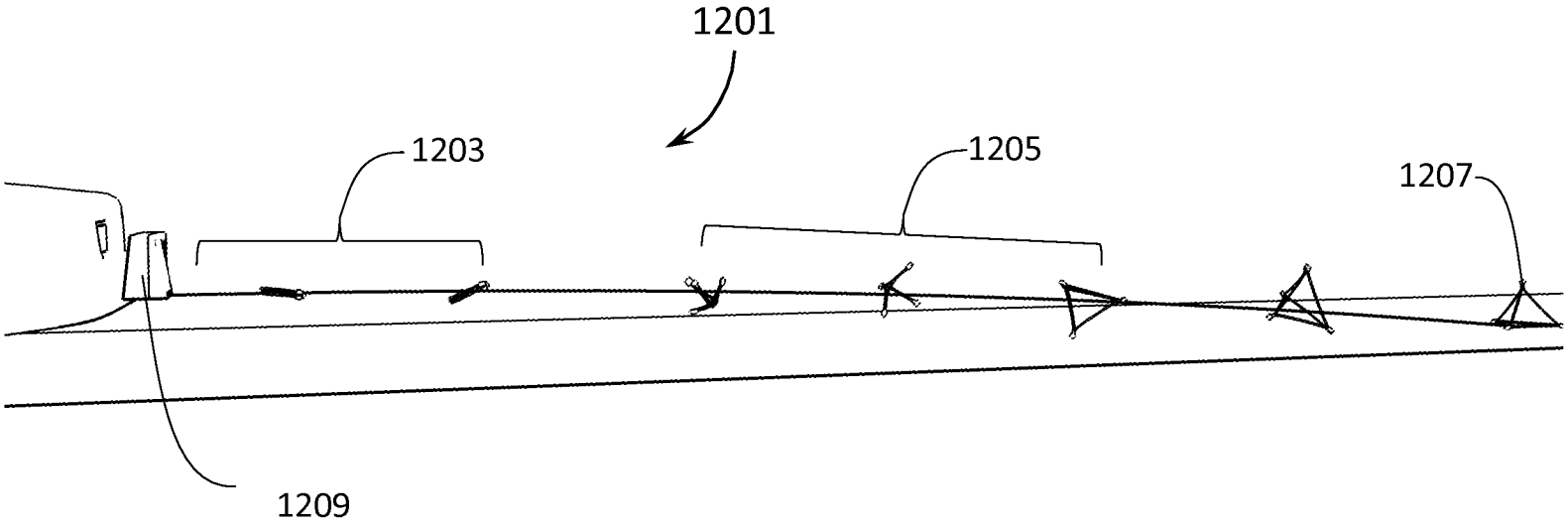
FIG. 12 is an illustration of the deployment phases of the example hollow marker shown in FIG. 5.

During the deployment process the markers go through a number of phases. FIG. 12 shows three main phases of the deployment of the marker presented in FIG. 6A to 6D, namely the ejection phase 1203, the expansion phase 1205 and the landing phase 1207. During the ejection phase 1203, the marker is ejected from the marker dispenser 1209. In the expansion phase 1205, the springy marker rods straighten and return to their nearly linear form allowing the marker to attain its expanded state. In the landing phase, the marker touches the ground at the target location.

Figure 13:
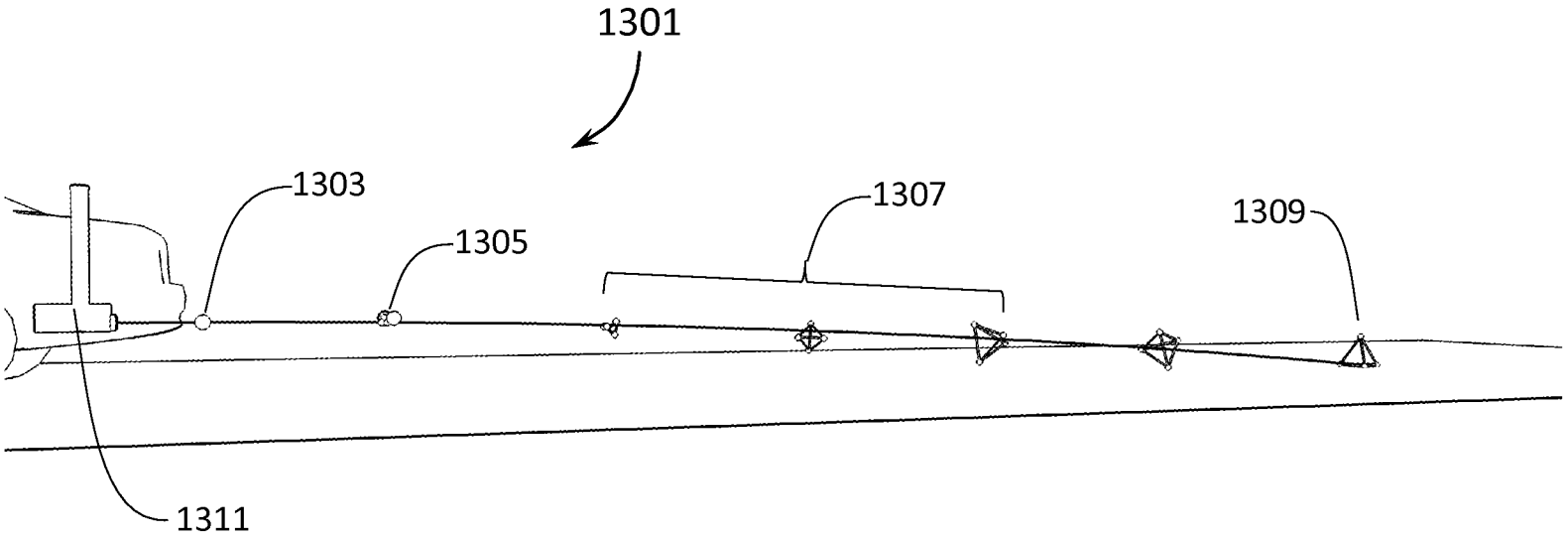
FIG. 13 is an illustration of the deployment phases of the example encapsulated hollow marker shown in FIG. 2.

FIG. 13 shows the four main phases of the alternate marker presented in FIGS. 4A to 4C, namely the ejection phase 1303, the liberation phase 1305, the expansion phase 1307 and the landing phase 1309. During the ejection phase 1303, the marker located in its encapsulation shells is ejected from the marker dispenser 1311. During the liberation phase 1305, the marker encapsulation shells are allowed to separate in order to release the marker. The other phases are identical to those presented in the previous paragraph.

In one embodiment of the invention, the encapsulation shells are separated under the strength of the impact of the ball with the ground. In one embodiment, after release of the marker, the encapsulation shells remain attached to the vertices or the rods. In another embodiment, the encapsulation shells are part of the vertex elements, each vertex element having a section of the encapsulation shell adapted to mate with the others to form the ball.

In one embodiment of the invention, the method used to maintain the encapsulated marker presented in FIG. 4A to 4C is an elastic membrane similar to the latex used in common inflatable birthday balloons. As the markers are ejected, their surface come in contact with sharp blades located inside the ejection mechanism, thereby causing small cuts in the elastic membrane which rips apart due to its high surface tension, thus separating the enclosing shells and freeing the marker. In another embodiment, no shells are used and the marker is enclosed directly inside the flexible membrane.

In one embodiment of the invention, the markers are designed so that the light flashes emitted by markers is synchronized to improve visibility, to improve depth perception and to minimize visual confusion. In one mode the markers can flash simultaneously. In another mode the markers emit a "chase" waveform, that is a flash of light from one marker at a time, in the order from the farther to the closer to the dispenser. This mode provides a better depth perception and suggests a safe obstacle-avoiding path to the drivers of incoming traffic. Other synchronized modes of lighting such as a "chase" waveform from the closer to the farther to the dispenser, or combinations can also be implemented.

The synchronization of the marker flashing can be performed using a synchronization radio frequency signal emitted by a circuit located in the marker dispenser. This master signal can instruct each marker when to emit their flash. Alternatively, the master signal can emit a signal to synchronize clocks embedded in each marker. This synchronization of clock process can be quite infrequent, depending on the accuracy of the marker clocks. The markers can follow the sequence with a common fixed period and with a delay that is preprogrammed in each of them. The spatial ordering (chase effect) of the flashes is achieved by the correct ordering of the markers inside the marker cartridge at factory.

Alternatively, the marker light emission can be regulated by marker-to-marker communication. This communication can be achieved using radio frequency, optical communication or any other suitable method.

Radio frequency synchronization between markers may require unique marker identification numbers and ordering in the cartridge, for the flashes to be spatially ordered (chase effect) when deployed.

Optical communication for inter-marker synchronization requires the use of a photodetector in each marker to sense the ambient light. The light emission capability is already present; it is the light sources used to produce the flashes. The photodetector can also be used to sense ambient light and to suppress flashing during daytime. This feature is useful to save battery power.

Using the optical approach at nighttime, the markers can synchronize with the other markers simply by establishing a master—slaves configuration. As soon as one marker is deployed and triggered, this marker monitors and "looks" for a few (for example three) light flashes at a nominal frequency f. If no such flashes are detected, it is because this is the first marker, so it becomes the master and starts flashing at the nominal frequency f, for example one flash per second. For the other markers, as soon as a few (for example three) flashes are detected, the receiving marker becomes a slave and from this point on, the slave marker will echo detected flashes that match (within a tolerance margin) the amplitude of the initial flashes. A small delay of a fraction of a second is used between the detection and the emission in order to create the chase effect. After a slave marker has echoed a flash, it inhibits echoing of other detected flashes for a time period slightly shorter than the cycle time to avoid picking up flashes from other slaves down the line and create double echoes.

After usage, the markers can be picked up manually and stored in a bag for return to the factory, where they can be refurbished into a new cartridge.

The applications for this invention are numerous. The applications include the set-up of a safety perimeter to protect first respondents at a site of a road accident including: paramedics, law officers, firemen, and tow truck operators. Other applications include the protection of workers at a site of a road spill, of utilities employees working near roads, of road construction workers, of children playing basketball or hockey in the street, of emergency personnel caring to an injured skier on a ski slope, etc. The markers are therefore useful to divert traffic by creating a visual indicator, irrespective of the type of traffic (humans, vehicles, etc).

The embodiments described above are intended to be exemplary only.

The invention claimed is:

1. A safety marker apparatus, comprising:

a hollow body including at least four vertex elements interconnected by flexible resilient rods, said body being adapted to be compressed into a stowed state upon application of an external force and expanded into a deployed state, said flexible resilient rods forcing said hollow body to adopt said deployed state in an absence of said external force, wherein one of said at least four vertex elements is adapted to mate with others of said at least four vertex elements in said stowed state.

2. The safety marker apparatus as claimed in claim 1, further comprising at least one fabric sheet, said fabric sheet being attached to said hollow body, said fabric sheet being flexible and adapted to move with air circulation.

3. The safety marker apparatus as claimed in claim 1, further comprising an encapsulating shell for receiving and retaining said body in said stowed state.

4. The safety marker apparatus as claimed in claim 1, further comprising a retaining band, said retaining band being adapted to retain said body in said stowed state.

5. The safety marker apparatus as claimed in claim 1, further comprising at least one retro-reflecting element affixed to said body.

6. The safety marker apparatus as claimed in claim 1, wherein a configuration of said vertex elements and said rods provides a substantially symmetrical hollow body.

7. The safety marker apparatus as claimed in claim 1, wherein said at least four vertex elements is four vertex elements and wherein said four vertex elements are interconnected by six flexible resilient rods.

8. The safety marker apparatus as claimed in claim 1, wherein at least one of said at least four vertex elements is an illuminating vertex element, wherein said safety marker apparatus further comprises a battery-powered light source provided in said illuminating vertex elements, said battery-powered light source being switched on in said deployed state and being switched off in said stowed state.

9. The safety marker apparatus as claimed in claim 8, further comprising a magnetic switch for said battery-powered light source and a permanent magnet, wherein said battery-powered light source is switched off by a proximity of said permanent magnet to said illuminating vertex element in said stowed state and switched on by a distance of said permanent magnet from said illuminating vertex element in said deployed state.

10. The safety marker apparatus as claimed in claim 9, wherein said permanent magnet is provided on one of another one of said at least four vertex elements and a casing for said marker.

11. The safety marker apparatus as claimed in claim 8, further comprising a controller for said battery-powered light source, said controller controlling said battery-powered light source to emit light one of continuously and intermittently.

12. The safety marker apparatus as claimed in claim 11, further comprising an optical detector for detecting an illumination signal, wherein said controller controls at least one of a frequency and a timing of intermittent illumination of said battery-powered light source using said illumination signal.

* * * * *